US006601774B1

(12) United States Patent
Kasimoff

(10) Patent No.: US 6,601,774 B1
(45) Date of Patent: Aug. 5, 2003

(54) TOY TRACK SYSTEM

(76) Inventor: Mark P. Kasimoff, P.O. Box 94181, Pasadena, CA (US) 91109-4181

( * ) Notice: Subject to any disclaimer, the term of this patent is extended or adjusted under 35 U.S.C. 154(b) by 0 days.

(21) Appl. No.: 10/170,838

(22) Filed: Jun. 11, 2002

(51) Int. Cl.[7] ..... E01B 23/00
(52) U.S. Cl. ..... 238/10 R; 104/60
(58) Field of Search ..... 238/10 R, 10 A, 238/10 B, 10 C, 10 E, 10 F; 104/60

(56) References Cited

U.S. PATENT DOCUMENTS

| | | | | | |
|---|---|---|---|---|---|
| 1,350,873 | A | * | 8/1920 | Lombardo | 104/60 |
| 3,487,999 | A | | 1/1970 | Nash et al. | 238/10 |
| 3,707,804 | A | | 1/1973 | Cook | 46/202 |
| 3,712,540 | A | | 1/1973 | Yamasaki et al. | 238/10 |
| 3,734,404 | A | | 5/1973 | Baynes et al. | 238/10 |
| 3,815,817 | A | * | 6/1974 | Bamford | 238/10 R |
| D233,620 | S | | 11/1974 | Seki | D34/15 |
| 3,961,751 | A | * | 6/1976 | Kessler | 238/10 R |
| 4,544,094 | A | | 10/1985 | Scholey | 238/10 |
| 5,074,465 | A | | 12/1991 | Nepper | 238/10 |
| 5,392,987 | A | * | 2/1995 | Ropers et al. | 238/10 E |
| 5,452,893 | A | | 9/1995 | Faulk et al. | 273/86 |
| 5,868,076 | A | * | 2/1999 | Myus et al. | 104/60 |
| 6,427,926 | B1 | * | 8/2002 | Lai | 238/10 R |

* cited by examiner

*Primary Examiner*—Mark T. Le

(57) ABSTRACT

A toy track system that is economical, expandable and portable. The toy track system includes a track section having one or more track lanes, a first side member, and a second side member, wherein the second side member catchably receives the first side member for allowing side-to-side attachment of a plurality of track sections. The second side member has a slot with an inner channel that snugly receives a T-shaped extension from the first side member.

20 Claims, 6 Drawing Sheets

TOY TRACK SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to toy tracks and more specifically it relates to a toy track system that is economical, expandable and portable.

2. Description of the Related Art

Toy tracks have been in use for years. A conventional toy track is typically comprised of a single lane structure that receives a toy vehicle. Conventional tracks also typically allow for the connection of adjacent tracks in an end-to-end manner for increasing the overall length of the track. Conventional toy tracks do not allow for the addition of parallel track lanes.

Examples of patented devices which may be related to the present invention include U.S. Pat. No. 3,707,804 to Cook; U.S. Pat. No. 5,074,465 to Nepper; U.S. Pat. No. 3,712,540 to Yamasaki et al.; U.S. Pat. No. 3,734,404 to Baynes et al.; U.S. Pat. No. 3,487,999 to Nash et al.; U.S. Pat. No. 233,620 to Seki; U.S. Pat. No. 5,452,893 to Faulk et al.; and U.S. Pat. No. 4,544,094 to Scholey.

While these devices may be suitable for the particular purpose to which they address, they are not as suitable for providing expandability. Conventional toy track devices allow for the extension of the overall length of the track, however do not provide for the expansion of the number of race tracks running parallel to one another.

In these respects, the toy track system according to the present invention substantially departs from the conventional concepts and designs of the prior art, and in so doing provides an apparatus primarily developed that is economical, expandable and portable.

BRIEF SUMMARY OF THE INVENTION

In view of the foregoing disadvantages inherent in the known types of toy tracks now present in the prior art, the present invention provides a new toy track system construction that is economical, expandable and portable.

The general purpose of the present invention, which will be described subsequently in greater detail, is to provide a new toy track system that has many of the advantages of the toy tracks mentioned heretofore and many novel features that result in a new toy track system which is not anticipated, rendered obvious, suggested, or even implied by any of the prior art toy tracks, either alone or in any combination thereof.

To attain this, the present invention generally comprises a track section having one or more track lanes, a first side member, and a second side member, wherein the second side member catchably receives the first side member for allowing side-to-side attachment of a plurality of track sections. The second side member has a slot with an inner channel that snugly receives a T-shaped extension from the first side member.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a toy track system that will overcome the shortcomings of the prior art devices.

A second object is to provide a toy track system that is economical, expandable and portable.

Another object is to provide a toy track system that allows for the addition of parallel track lanes.

An additional object is to provide a toy track system that is easy to utilize.

A further object is to provide a toy track system that decreases the amount of time required to setup a track structure.

Another object is to provide a toy track system that may be utilized within various environments.

A further object is to provide a toy track system that provides a finite distance between each track lane to prevent interference with adjacent toy vehicles.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
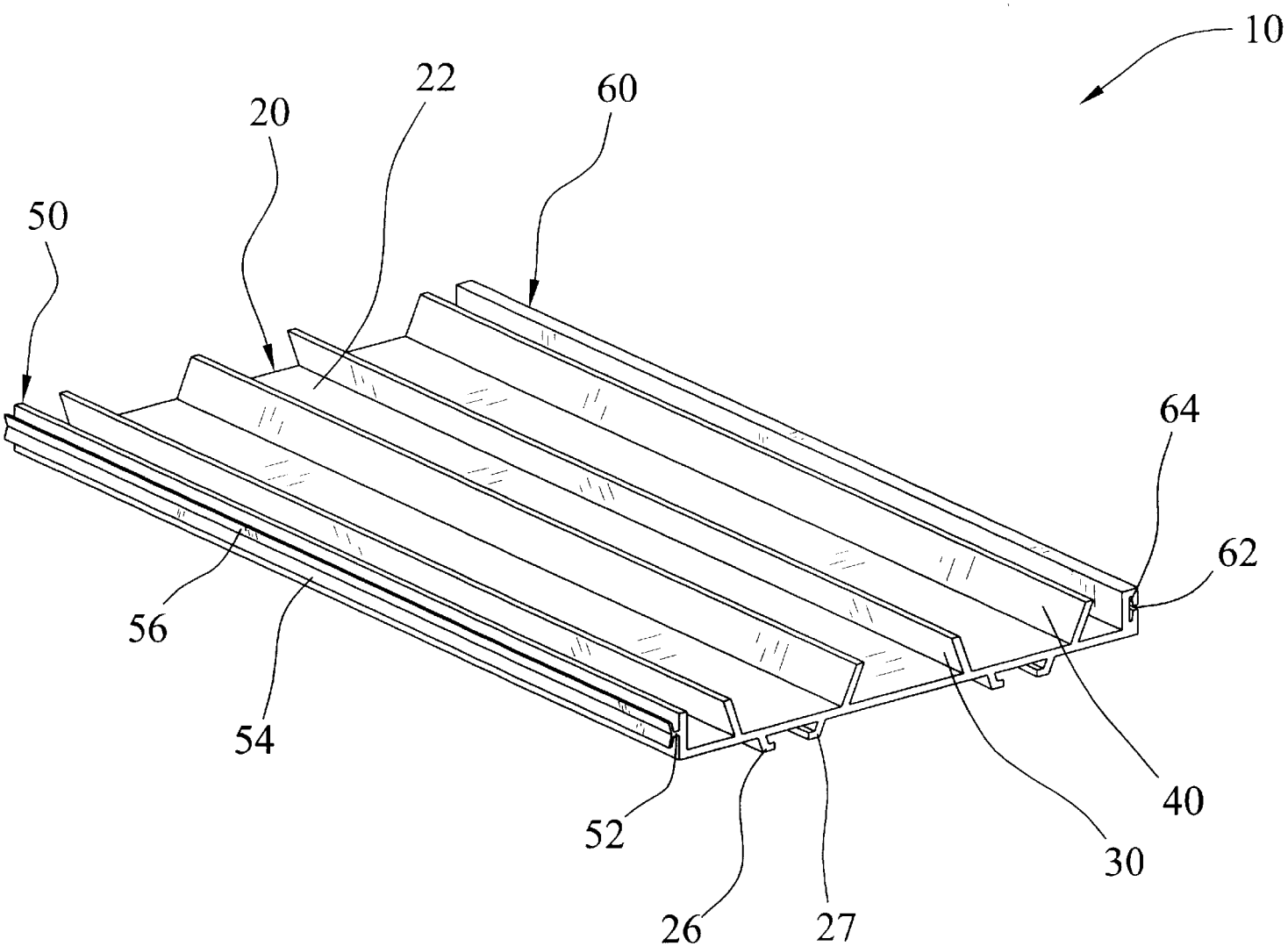
FIG. 1 is an upper perspective view of the present invention.

Turning now descriptively to the drawings, in which similar reference characters denote similar elements throughout the several views, FIGS. 1 through 6 illustrate a toy track system 10, which comprises a track section 20 having one or more track lanes, a first side member 50, and a second side member 60, wherein the second side member 60 catchably receives the first side member 50 for allowing side-to-side attachment of a plurality of track sections 20. The second side member 60 has a slot 62 with an inner channel 64 that snugly receives a T-shaped extension from the first side member 50.

As shown in FIGS. 1 through 6 of the drawings, the track section 20 is comprised of an elongate structure having one or more track lanes for movably receiving a toy vehicle 12. The track section 20 may be comprised of various materials such as but not limited to plastic and metal. The track section 20 may also be manufactured utilizing various manufacturing techniques such as but not limited extrusion.

Figure 2:
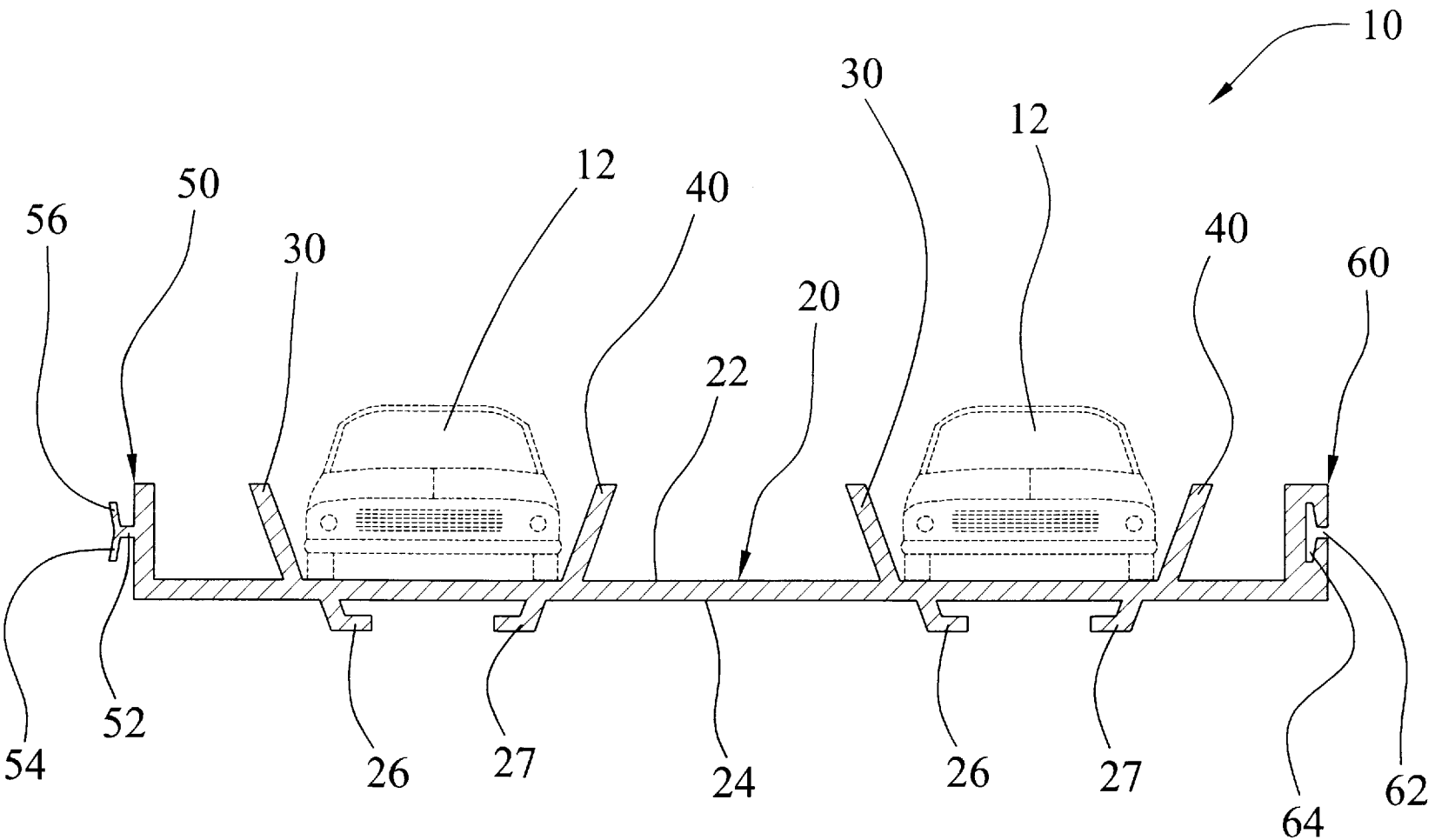
FIG. 2 is an end cutaway view of the present invention with toy vehicles within the first and second tracks.

The track section 20 includes an upper surface 22 that supports the toy vehicles 12 and a bottom surface 24 as best shown in FIG. 2 of the drawings. The track section 20 preferably has a flat and straight structure, however the track section 20 may have various other shapes and structures commonly utilized within the toy track industry. The length of the track section 20 is preferably at least six feet in length, however shorter lengths may be utilized to construct the track section 20.

As best shown in FIGS. 1 and 2 of the drawings, a plurality of track lanes are positioned parallel to one another within the track section 20. Each of the track lanes has a first wall 30 and a second wall 40 having a finite distance from one another for movably receiving and guiding the toy vehicles 12. The walls 30, 40 are preferably angled outwardly from the upper surface 22 and away from one another as best shown in FIG. 2 of the drawings. The walls may have various other angles and structures other than illustrated in the drawings.

A first rail 26 and a second rail 27 are attached to the opposing distal ends of the track section 20 for snugly receiving a flat connector member 28 for allowing end-to-end connection of a plurality of track sections 20. The first rail 26 and the second rail 27 are commonly utilized within the toy track industry and may be comprised of other attachment structures commonly utilized within the toy track industry.

As shown in FIGS. 1 and 2 of the drawings, the first side member 50 extends along a side of the track section 20 opposite of the second side member 60. The first side member 50 has a T-shaped structure extending from thereof that interconnects with the second side member 60. The T-shaped structure is comprised of an extension portion 52, a lower flange 54 and an upper flange 56 extending opposite of the lower flange 54. As best shown in FIG. 2 of the drawings, the lower flange 54 and the upper flange 56 extend outwardly (or inwardly) at an angle for increasing the frictional engagement with the inner channel 64 of the second side member 60.

Figure 3:
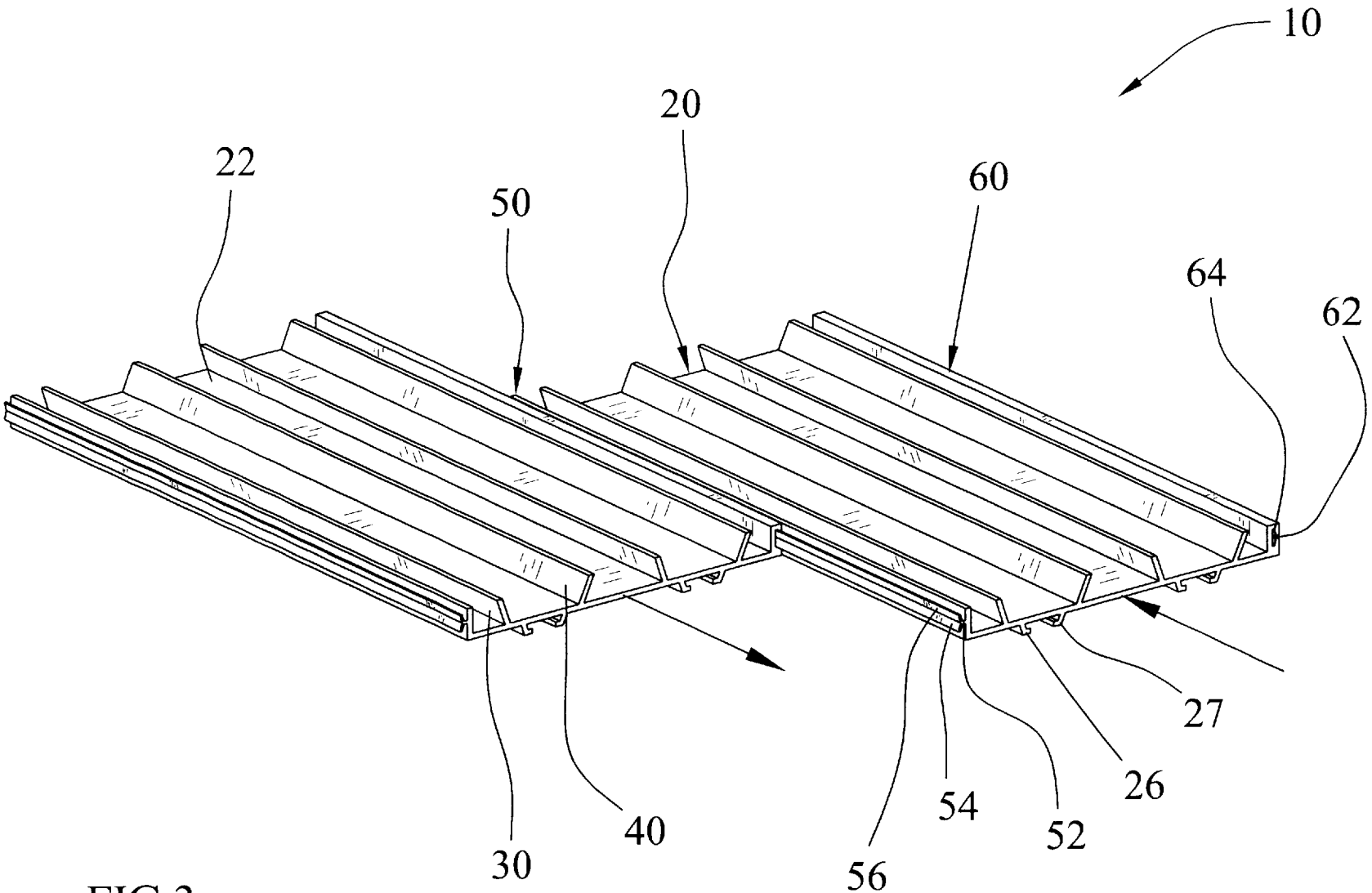
FIG. 3 is an upper perspective view illustrating two track sections of the present invention being interconnected.
Figure 4:
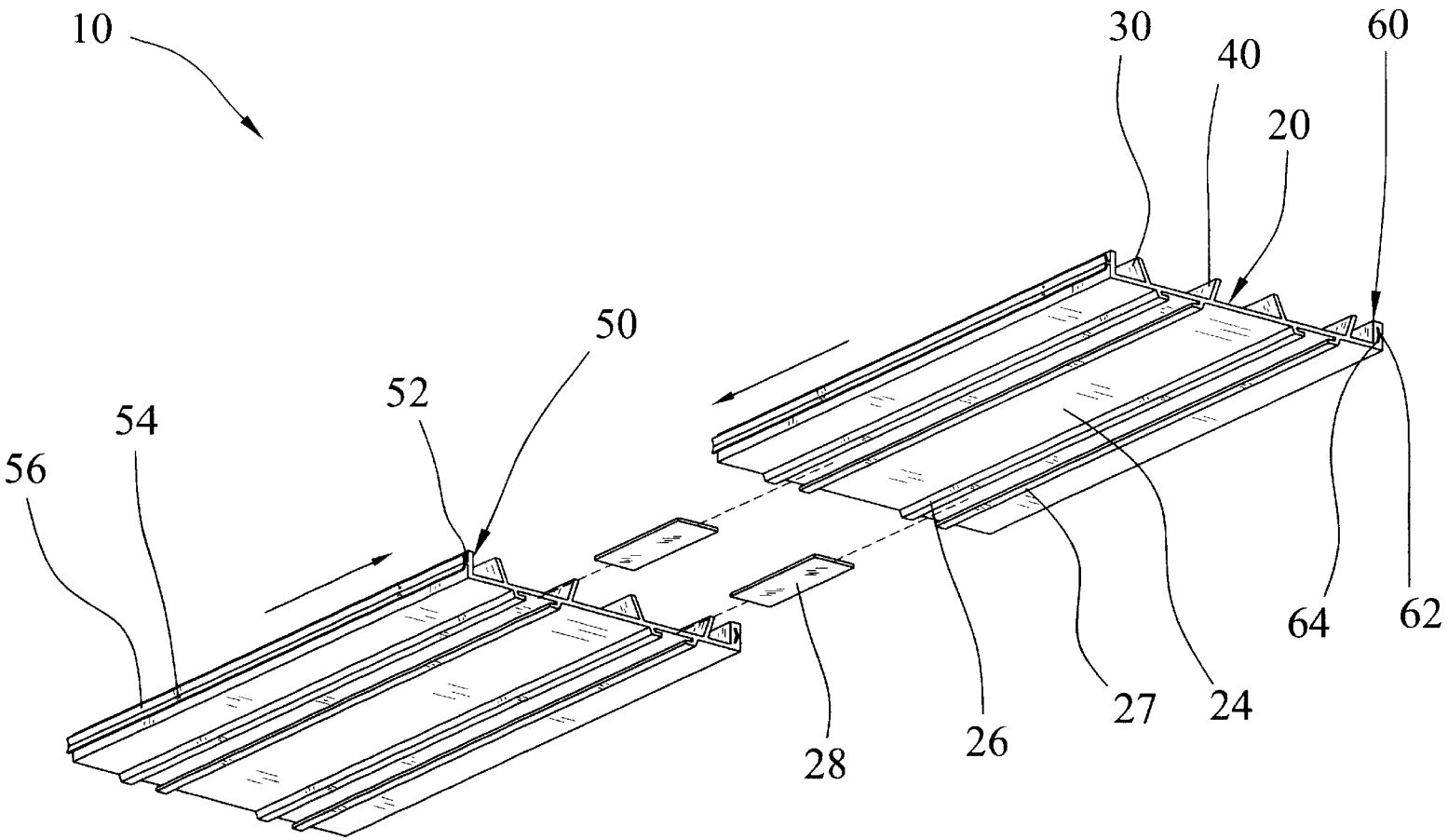
FIG. 4 is a lower exploded perspective view of two track sections and a pair of connector members.
Figure 5:
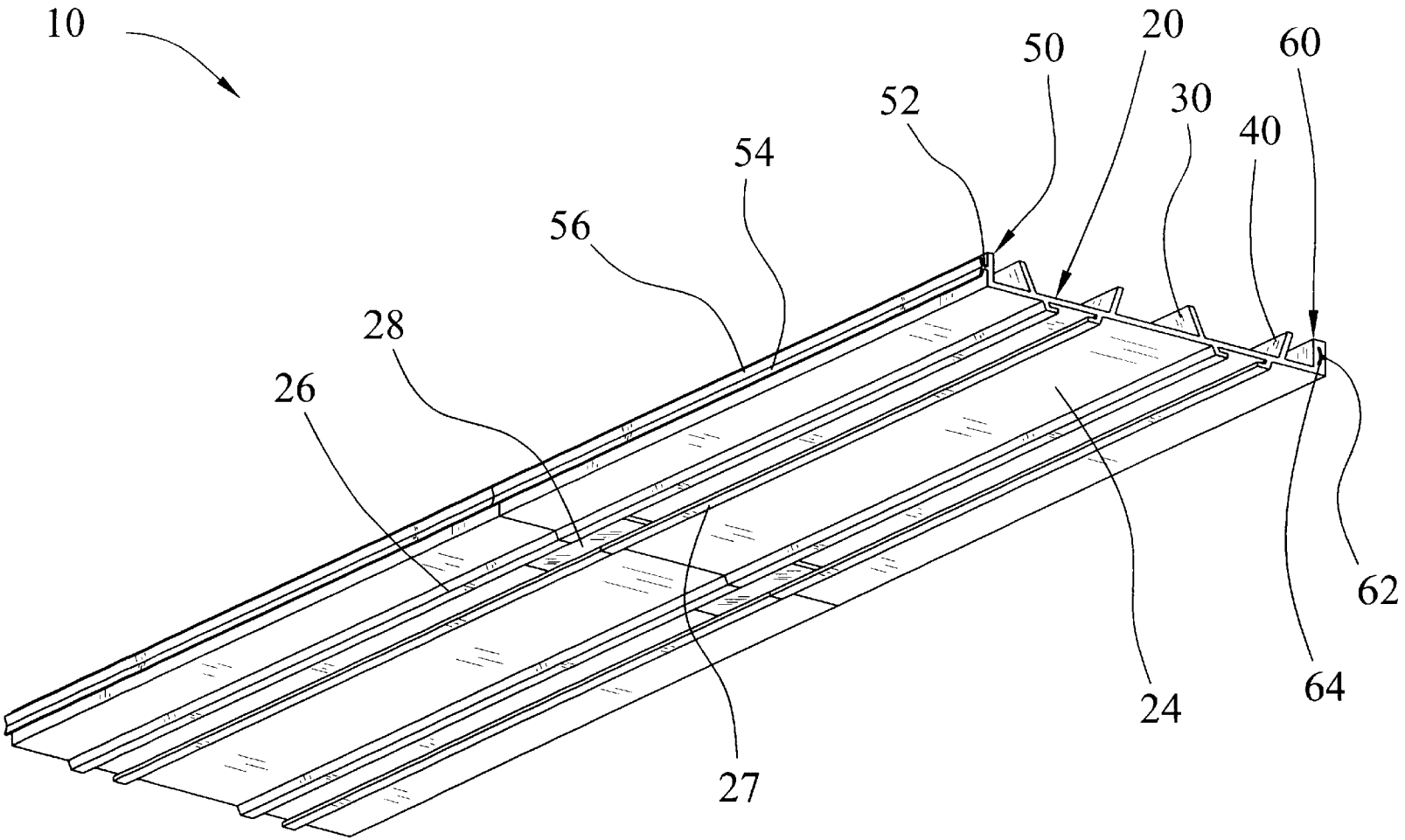
FIG. 5 is a lower perspective view of two track sections connected end to end.

As shown in FIGS. 1 and 3 of the drawings, the second side member 60 extends along a side of the track section 20 opposite of the first side member 50. The second side member 60 includes a longitudinal slot 62 with an inner channel 64 connected to the slot 62. The inner channel 64 has a T-shaped structure that receives the extension portion 52 and the flanges 54, 56 of the first side member 50 in a slidable and frictional manner for allowing the interconnection of a plurality of track sections 20 in a side-to-side manner.

The spacing between the walls 30, 40 and the respective side members 50, 60 is preferably equal to the distance between the walls 30, 40 between the track lanes thereby providing equal spacing of the track lanes when a plurality of track sections 20 are interconnected. In addition, the spacing between the track lanes is sufficient so as to prevent interference between toy vehicles 12 that accidentally leave a track lane.

Figure 6:
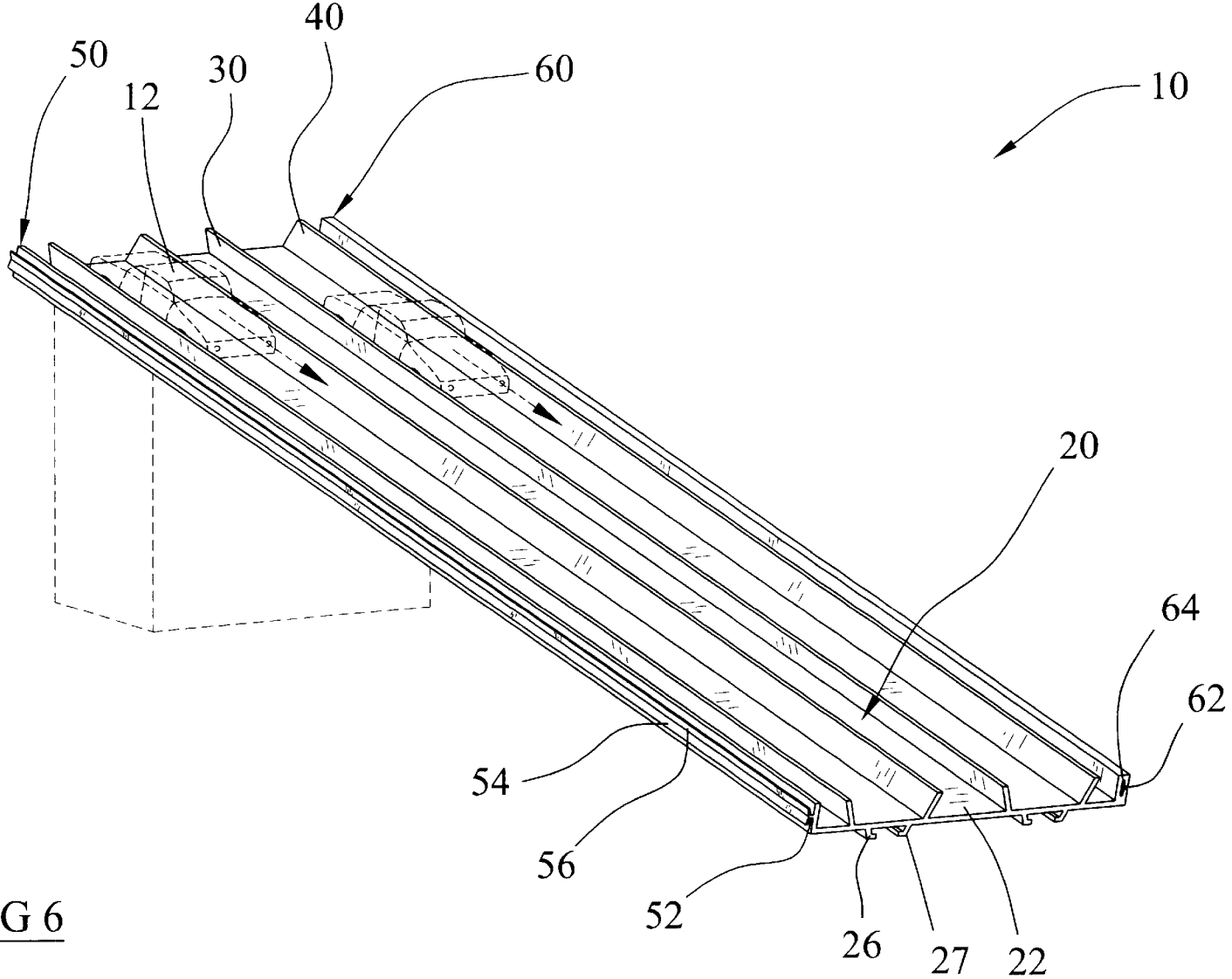
FIG. 6 is an upper perspective view of the present invention supported at an angle upon an object.

In use, the user determines the number of track lanes required and the overall length of the track. The user then connects the track sections 20 in a side-to-side manner to achieve the desired number of track lanes by connecting the first side member 50 within the second side member 60. The user then connects additional track sections 20 in an end-to-end manner to increase the length of the track if desired. This process continues until the desired track length, number of lanes and track shape are formed. The user then may temporarily or permanently attach a portion of the track to an object for elevating the track as shown in FIG. 6 of the drawings. The user is then able to place one or more toy vehicles 12 upon the track within a respective track lane and allow the toy vehicles 12 to roll freely within the track lanes in a racing manner. When finished, the user is able to disassemble the track sections 20 from one another for easy storage in a convenient location.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A toy track system having a plurality of track sections interconnectable in a side-to-side manner, each of said plurality of track sections comprising:

at least one track lane having a first wall and a second wall;

a first side member having a T-shaped extension; and a second side member having a slot and an inner channel for slidably receiving said T-shaped extension, wherein said second side member is opposite of said first side member.

2. The toy track system of claim 1, wherein said T-shaped extension has an extension portion, a lower flange extending from said extension portion, and an upper flange extending from said extension portion.

3. The toy track system of claim 2, wherein said lower flange and said upper flange extend outwardly at an angle.

4. The toy track system of claim 2, wherein said lower flange and said upper flange extend inwardly at an angle.

5. The toy track system of claim 1, wherein said slot and said inner channel form a T-shaped channel for receiving said T-shaped extension.

6. The toy track system of claim 1, wherein said first side member extends along an entire length of said track section.

7. The toy track system of claim 1, wherein said second side member extends along an entire length of said track section.

8. The toy track system of claim 1, wherein said first wall and said second wall extend outwardly at an angle from one another.

9. The toy track system of claim 1, wherein said at least one track lane is comprised of a plurality of track lanes parallel to one another and spaced apart a distance X.

10. The toy track system of claim 9, wherein a distance from said second wall to said second side member is approximately half of said distance X, and wherein a distance from said first wall to said first side member is approximately half of said distance X.

11. A toy track system having a plurality of track sections interconnectable in a side-to-side manner, each of said plurality of track sections comprising:

a plurality of track lanes having a first wall and a second wall extending from an upper surface of said track section in a parallel manner;

a first side member having a T-shaped extension parallel to said plurality of track lanes; and a second side member having a slot and an inner channel for slidably receiving said T-shaped extension, wherein said second side member is opposite of said first side member.

12. The toy track system of claim 11, wherein said T-shaped extension has an extension portion, a lower flange extending from said extension portion, and an upper flange extending from said extension portion.

13. The toy track system of claim 12, wherein said lower flange and said upper flange extend outwardly at an angle.

14. The toy track system of claim 12, wherein said lower flange and said upper flange extend inwardly at an angle.

15. The toy track system of claim 11, wherein said slot and said inner channel form a T-shaped channel for receiving said T-shaped extension.

16. The toy track system of claim 11, wherein said first side member extends along an entire length of said track section.

17. The toy track system of claim 11, wherein said second side member extends along an entire length of said track section.

18. The toy track system of claim 11, wherein said first wall and said second wall extend outwardly at an angle from one another.

19. The toy track system of claim 11, wherein said at least one track lane is comprised of a plurality of track lanes parallel to one another and spaced apart a distance X.

20. The toy track system of claim 19, wherein a distance from said second wall to said second side member is approximately half of said distance X, and wherein a distance from said first wall to said first side member is approximately half of said distance X.

* * * * *